United States Patent [19]

Panyard et al.

[11] Patent Number: 4,986,230

[45] Date of Patent: Jan. 22, 1991

[54] METHOD OF JOINING CYLINDER BORE LINERS TO AN ENGINE BLOCK

[75] Inventors: James R. Panyard, Livonia; Benjamin P. Winter, Canton, both of Mich.

[73] Assignee: Ford Motor Company, Dearborn, Mich.

[21] Appl. No.: 457,644

[22] Filed: Dec. 27, 1989

[51] Int. Cl.[5] ..... F02F 1/00

[52] U.S. Cl. ..... 123/193 C; 123/668; 123/669; 29/888.061

[58] Field of Search ..... 123/193 C, 668, 669; 29/888.061

[56] References Cited

U.S. PATENT DOCUMENTS

| | | | |
|---|---|---|---|
| 1,402,508 | 1/1922 | Lathrop . | |
| 1,722,389 | 7/1929 | Opie et al. . | |
| 2,353,774 | 7/1944 | Wagner | 29/888.061 |
| 2,435,837 | 2/1948 | Larson . | |
| 2,613,431 | 10/1952 | McGee . | |
| 3,372,452 | 3/1968 | Firth et al. . | |
| 4,221,196 | 9/1980 | Castarede | 123/193 C |
| 4,370,788 | 2/1983 | Baker | 29/888.061 |
| 4,700,444 | 10/1987 | Yamagata | 29/888.061 |

*Primary Examiner*—Andrew M. Dolinar
*Assistant Examiner*—M. Macy
*Attorney, Agent, or Firm*—Joseph W. Malleck; Roger L. May

[57] ABSTRACT

Method of bonding cylinder liners to cylinder bore walls, comprising: (a) inserting a cylindrical work hardenable liner into a complementary sized cylindrical bore wall of the block, with a uniform annular radial spacing therebetween of about 0.005 inch; and (b) forcing a nondeformable mandrel throughout the interior length of the cylindrical liner to uniformly circumferentially expand the radially outer surface of the liner into full annular surface-to-surface heat exchange relationship with the interior surface of the bore wall, the mandrel having a cross-sectional radius greater than the interior radius of the liner by a dimension which is at least 0.001 inch in excess of such radial spacing. Preferably, the cylindrical liner is comprised of steel having a ductility of at least 30%, a hardness of at least 35 HRB, and a wall thickness in the range of 0.050–0.250. The mandrel is preferably formed as a spherical element by a process of pressing and sintering followed by precise grinding to shape, and has a hardness greater than either the liner or bore wall.

13 Claims, 3 Drawing Sheets

METHOD OF JOINING CYLINDER BORE LINERS TO AN ENGINE BLOCK

BACKGROUND OF THE INVENTION

1. Technical Field

This invention relates to the art of providing liners for cylinder bores of internal combustion engine blocks, and more particularly to techniques for joining such liners to the cast structure of such blocks.

2. Discussion of the Prior Art

Light alloy cast engine blocks provide an opportunity to achieve significant weight reduction when compared to traditional cast iron engine blocks. However, to provide a compatible wear surface for the pistons operating within such engine blocks, iron cylinder liners are commonly used. These liners are placed within the engine block by being cast-in-place or by being locked by an interference fit. Cast-in-place liners (such as disclosed in U.S. Pat. Nos. 3,521,613 and 4,252,175) add complexity to the casting process and increase the cost and severity of foundry scrap. The interference fit process permits first the casting of blocks without liners and thus reduces the scrap concerns; the liner is inserted subsequently by extensive heating of the blocks to achieve an expansion and then later cooling of the block with the liner in place to achieve the interference fit between the cylinder bore and the liner (see U.S. Pat. No. 3,372,452). This process slows and complicates the manufacture of engines within an engine plant, and, in general, is not suitable for high production volumes typical of major automotive engine plants.

To function properly, the inserted liners must have a full integral surface-to-surface bond that promotes thermal transfer as if the liner and cylinder bore were one unitary piece. This invention has discovered that staking can achieve such integral surface-to-surface bond without the need for heating. Applicants are unaware of any prior art that carries out staking of liners within cylinder bores for engine blocks.

Ball mandrel expansion has been used in the past for sizing of the interior surfaces of a tubular member (see U.S. Pat. Nos. 1,402,508; 1,722,389; and 2,613,431) without regard to any bonding of such tube to another body. Mandrel expansion has also been used to deform pipe shafts to irregular openings in cam lobes for making a camshaft (such as illustrated in U.S. Pat. Nos. 4,293,995; 4,382,390; and 4,597,365). But these disclosures require only that there be some keying to promote rotational drive therebetween and not a full circumferential thermal exchange interface.

Mandrel expansion has also been used to deform lips of cylinder liners, but never with the intent of promoting a full circumferential thermal exchange interface between the liner and a surrounding cylinder bore (see U.S. Pat. Nos. 2,435,837 and 3,372,452).

It is therefore an object of this invention to provide a highly efficient, productive and lower-cost method for joining cylinder liners to cylinder bores without the need for heating, which process provides stronger, more durable liners with thinner gauge metals and with less scrap.

SUMMARY OF THE INVENTION

This invention is a low-cost, simple insertion process for cylinder bore liners in engine blocks, which process can be performed at room temperature and at high production rates. It incorporates low-cost, readily available steel tubing as cylinder liners which are staked-in-place by forcing an appropriately sized ball through the cylinder liner. In the staking operation, the liner is expanded against the cylinder bore wall to achieve the equivalence of an interference fit. During this process, the liner is ballized to a desired appropriate size, geometry, and interior surface finish, and is work hardened. The entire operation is carried out at room temperature with due regard to a predetermined machine clearance between the liner and the cylinder bore prior to staking. Time and cost savings are significant and the engine block assembly is further reduced in weight due to the capability of using thinner steel liners without sacrificing stiffness, strength, or wearability.

Specifically, the method comprises: (a) inserting a cylindrical work hardenable liner into a complementary sized cylindrical bore wall of the block, with a uniform annular radial spacing therebetween of at least 0.005 inch; and (b) forcing a nondeformable mandrel throughout the interior length of the cylindrical liner to uniformly circumferentially expand the radially outer surface of the liner into full annular surface-to-surface heat exchange relationship with the interior surface of the bore wall, the mandrel having a cross-sectional radius greater than the interior radius of the liner by a dimension which is at least 0.001 inch in excess of such radial spacing.

Preferably, the cylindrical liner is comprised of steel having a ductility of at least 30% elongation, a hardness of at least 35 HRB, and a wall thickness in the range of 0.050–0.250 inch. The mandrel is preferably formed as a spherical or semispherical element by a process of pressing and sintering followed by precise grinding to shape, and has a hardness greater than the hardness of either the liner or block.

Preferably, during staking, the mandrel is moved through the liner at a lineal speed of 4–30 inches per second and with a ram force of about 10,000 pounds.

The product of such method may be a cast aluminum engine block having a ball-staked steel cylinder liner integrally bonded to the cylinder bore wall of the block, the liner being cold welded throughout the radially outer annular surface and throughout the actual length of the liner to provide a full integral heat exchange relationship, the liner having a mirror surface finish on its interior without the need for honing.

Preferably, the engine block assembly has the liner work hardened for retention within the cylinder bore wall with a hoop stress of at least 5000 psi. Advantageously, the liner has a length within the range of ½ to 15 inches and has both of its ends within the axial length of the cylinder bore wall; one of such ends may be recessed within the bore wall.

DETAILED DESCRIPTION AND BEST MODE

Figure 1:
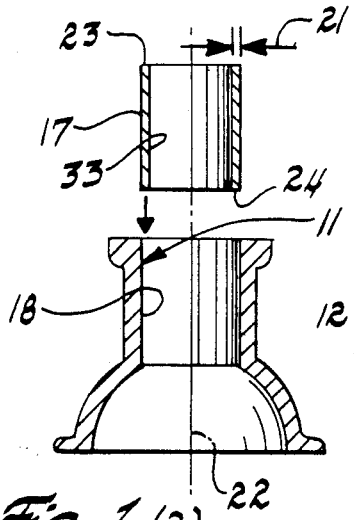
FIGS. 1(*a*)–1(*d*) are schematic illustrations of sequential steps used to carry out the method of this invention.
Figure 1:
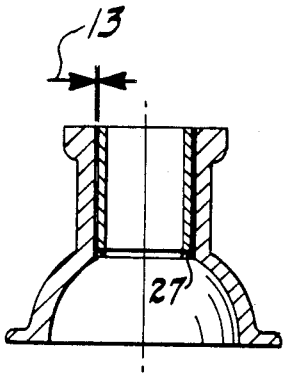
Figure 1:
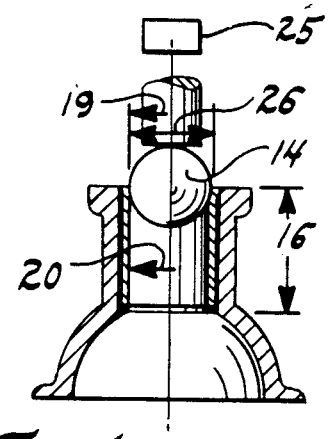
Figure 1:
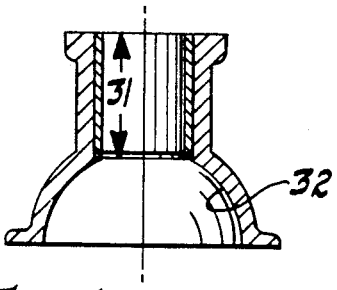
Figure 2:
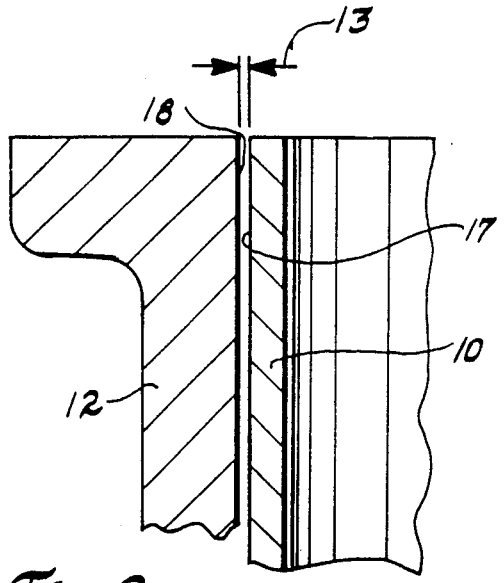
FIG. 2 is a greatly enlarged portion of the illustration in FIG. 1(*b*)
Figure 3:
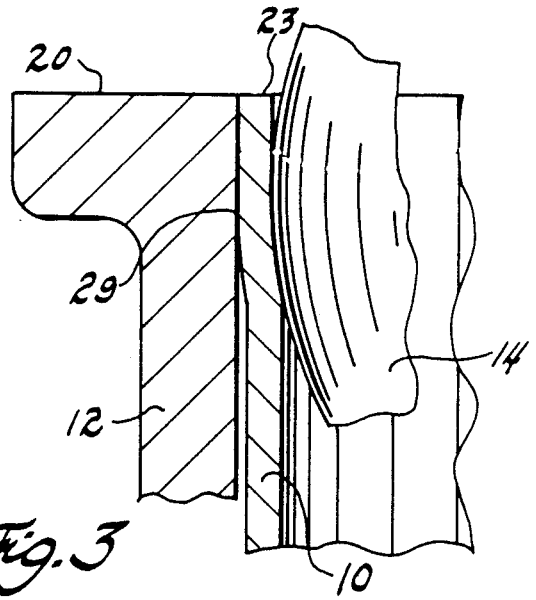
FIG. 3 is a greatly enlarged portion of the illustration in FIG. 1(*c*)
Figure 4:
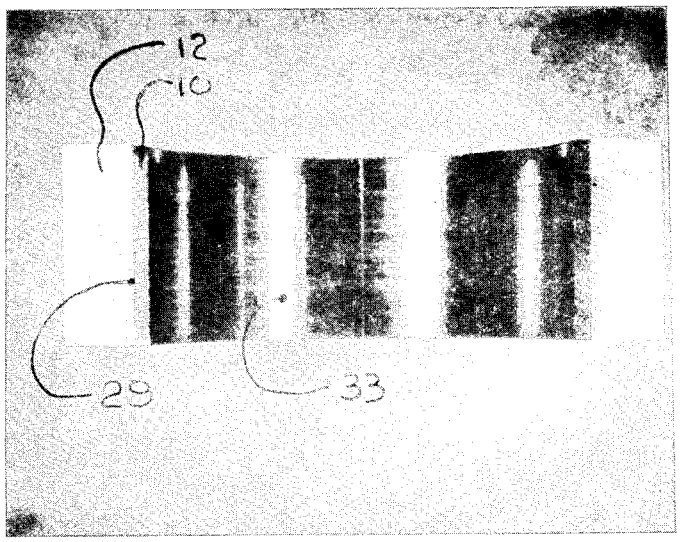
FIG. 4 is a macrophotograph of the cross-section of a ball-staked liner-block product showing the internal finish and sizing of the liner and the cold weld interface between the liner and the bore wall.

A cylinder liner 10 is ball-staked to a cast engine block bore wall 11, while at ambient conditions, by: (a) inserting the cylindrical work hardenable liner 10 into the complementary sized cylindrical bore wall 11 of the block 12, with a uniform annular spacing 13 therebetween of about 0.005 inches; and then (b) forcing a nondeformable mandrel 14 throughout the interior length 16 of the cylindrical liner to uniformly circumferentially expand the radially outer surface 17 of the liner into full annular surface-to-surface heat exchange relationship with the interior surface 18 of the bore wall 11, the mandrel having a cross-sectional radius 19 greater than the interior radius 20 of the liner by a dimension which is at least 0.001 inch in excess of the radial spacing.

The liner is comprised of a steel, plain carbon or alloy steel. The plain carbon steel may be low, moderate, or high carbon. Preferably, a low carbon steel is 1020, with a ductility of at least 30% elongation and a hardness of at least 35 HRB. The steel liner should have a wall thickness in the range of 0.100–0.250 inch and may be as thin as 0.050 inch. The cylinder bore is preferably a straight cylinder and the block is advantageously comprised of an aluminum alloy, such as AA319, such alloys being hypoeutectic and desirably contain silicon in an amount of 5.5–6.5%. The liner is also of a straight cylinder and has its ends 23, 24 cropped flat so as to fit flush within the cylinder bore wall. The cylinder block has a bore wall of a length 31 which opens into a crankcase chamber 32 of the block which is adapted to mate eventually with an oil pan housing.

The clearance 13 between the cylinder and liner is predetermined and should be in the range of 0.002–0.050 inch. If the clearance is less than 0.002 inch, then the following will result: difficulty or prevention of easy insertion; if the clearance is greater than 0.050 inch, then the following will result: excess force required for staking, possibly resulting in fracture of the liner. Preferably, the liner is inserted by sliding it telescopically along the axis of bore 22 until the ends 23, 24 of the liner are fully contained within the bore wall. One of the ends 24 may be recessed within the bore wall, such as shown at 27 in FIG. 1. The top end 23 should be flush with the gasket mounting surface 30 of the engine block 12.

The forcing step is carried out by moving the mandrel 14 by use of hydraulic or pneumatic means 25 through the liner at a lineal speed of desirably 4–30 inches per second and with a force of about 10,000 pounds. The mandrel will move (wipe) along the interior surface 33 of the liner to create a cold weld at the interface 29 through surface-to-surface interference. The interface 29 will be devoid of any air gaps around the entire circumference of the liner and throughout its axial length. To achieve such, the mandrel is preferably spherical in shape, and has a diameter 26 sized not only to create a surface-to-surface weld, but also to compensate for any spring-back of the steel liner that may result following the work hardening operation via forcing the mandrel through the liner.

The mandrel is comprised of a material harder than the liner or block, and is preferably made by a grinding to shape. It must have a spherical or semispherical shape at its sides that contact the interior of the liner. Although shown as a full sphere in FIG. 1, the mandrel may alternatively be a slice of a sphere or semisphere, provided the slice makes full annular contact with the liner.

The product resulting from the practice of the above method may constitute a unique assembly comprised of a cast aluminum engine block 12 having a ball-staked steel cylinder liner 10 integrally bonded to the interior cylinder bore wall 18 of the block, the liner being cold welded throughout its annular exterior surface 17 and throughout its axial length 16 providing a full integral surface-to-surface contact therebetween for improved heat exchange relationship, the liner having an interior mirror finish surface without the need for honing. The interior surface of such a ball-staked liner will have a substantially perfect roundness within a tolerance of 0.0004 inch and a surface finish characterized as being a mirror. The liner will have been work hardened to achieve such axial and circumferential weld and to have a hoop stress of at least 5000 psi retaining it within such cylinder bore. The liner will be expanded completely along the entire axis of the liner and bore, providing an interference fit generating unusually high hoop stresses in the bore and liner in the final assembly. Because the steel liner can be selected to have an unusually thin gauge, such as 0.050 inch, there may be a significant reduction in weight of the engine attributed to the combination of thinner liners and the use of an aluminum cast block. The steel liner will have a 50% increase in stiffness versus a cast iron liner, which will result in improved performance characteristics.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed:

1. A method of ball-staking a cylinder liner to a cast engine block bore while at ambient conditions, comprising:

(a) inserting a cylindrical work hardenable liner into a complementary sized cylindrical bore wall of said block, with a radial spacing therebetween of 0.005 inch; and (b) forcing a nondeformable mandrel throughout the interior length of said cylindrical liner to uniformly circumferentially expand the radially outer surface of said liner into full annular surface-to-surface heat exchange relationship with the interior surface of said bore wall, said mandrel having a cross-sectional radius greater than the interior radius of said liner by a dimension which is at least 0.001 inch in excess of said radial spacing.

2. The method as in claim 1, in which said liner is comprised of steel having a ductility of at least 30% and a hardness of at least 35 HRB, and a wall thickness in the range of 0.050–0.250 inch.

3. The method as in claim 1, in which said engine block is comprised of a hypoeutectic aluminum or aluminum alloy.

4. The method as in claim 1, in which said mandrel is spherically or semispherically shaped and comprised of a material harder than said liner or block.

5. The method as in claim 1, in which said forcing is carried out by moving the mandrel through the liner at a lineal speed of 4–30 inches per second and with a force of about 10,000 pounds.

6. The method as in claim 1, in which said mandrel, during step (b), moves along the interior of said liner to create a cold weld throughout substantially the entire axial length of said liner as well as substantially the entire circumferential extent of said liner.

7. The method as in claim 1, in which said step (a) is carried out by sliding the liner telescopically along the axis of the bore 22 until both ends of the liner are contained within the bore.

8. The method as in claim 1, in which said mandrel has a diameter sized to not only create a full surface-to-surface weld between the liner and bore wall, but to compensate for any spring-back of the liner metal that would detract from said weld.

9. The method as in claim 8, in which said liner has an axial length in the range of 0.5–15 inches.

10. The method as in claim 1, in which liners are inserted into a plurality of aligned cylinder bore walls and coordinated mandrels are forced throughout all of the liners simultaneously to achieve concomitant ball-staking of said plurality of bore walls and liners.

11. An assembly comprising a cast aluminum engine block having ball-staked steel cylinder liners integrally bonded to the interior cylinder bore walls of said block, the liners being cold welded throughout their outer annular surface and throughout the axial length of the liner surface to provide a full integral heat exchange relationship, said liner having a mirror surface finish on its interior surface without the need for honing.

12. The method as in claim 11, in which said liners have substantially perfect roundness within a tolerance of 0.0004 inch.

13. The assembly as in claim 11, in which said liner has an axial length commensurate with the length of said cylinder bore.

* * * * *